US011298602B2

(12) United States Patent
Lloyd

(10) Patent No.: US 11,298,602 B2
(45) Date of Patent: Apr. 12, 2022

(54) PORTABLE TRAINING DEVICE

(71) Applicant: Dribble Stick Training, LLC, Flint, MI (US)

(72) Inventor: Luke Christopher Lloyd, Flint, MI (US)

(73) Assignee: Dribble Stick Training, LLC, Flint, MI (US)

( * ) Notice: Subject to any disclaimer, the term of this patent is extended or adjusted under 35 U.S.C. 154(b) by 120 days.

(21) Appl. No.: 16/896,394

(22) Filed: Jun. 9, 2020

(65) Prior Publication Data

US 2021/0379462 A1 Dec. 9, 2021

(51) Int. Cl.
*A63B 69/00* (2006.01)
*A63B 69/34* (2006.01)

(52) U.S. Cl.
CPC ..... *A63B 69/34* (2013.01); *A63B 69/0071* (2013.01); *A63B 2210/50* (2013.01); *A63B 2243/0037* (2013.01)

(58) Field of Classification Search
CPC ..... A63B 69/34; A63B 69/0071; A63B 69/00; A63B 69/0002; A63B 2069/0008; A63B 2210/50; A63B 2243/0037
See application file for complete search history.

(56) References Cited

U.S. PATENT DOCUMENTS

| | | | |
|---|---|---|---|
| 1,038,198 | A | 9/1912 | Randall et al. |
| 2,262,939 | A | 11/1941 | Howard |
| 2,345,650 | A | 4/1944 | Attwood |
| 3,178,775 | A | 4/1965 | Tassell |
| 3,186,561 | A | 6/1965 | Strassle |
| 3,451,183 | A | 6/1969 | Lespagnol et al. |
| 3,574,367 | A | 4/1971 | Jankowski |
| 4,163,537 | A | 8/1979 | Mourgue |
| 4,641,983 | A | 2/1987 | Strassle |
| 4,805,365 | A | 2/1989 | Bastian |
| 4,997,001 | A | 3/1991 | DiCarlo |
| 5,864,997 | A | 2/1999 | Kelly |
| 6,179,511 | B1 | 1/2001 | Gassler |
| 8,647,220 | B2 | 2/2014 | Lloyd |

(Continued)

OTHER PUBLICATIONS

Webpage download, CarrLane, 2006, www.carrlane.com, 7 pages.

(Continued)

*Primary Examiner* — Raleigh W Chiu
(74) *Attorney, Agent, or Firm* — Dinsmore & Shohl LLP

(57) ABSTRACT

A portable training device includes a first and second elongated members, a coupling device, a base, a holder device, and a member holder. An elongated slot is positioned between a distal end and a proximate end on at least one side of each of the first and second elongated members. The first elongated member and second elongated member are each received by the coupling device to form a post that extends in a system vertical direction. The member holder has an engagement portion and a member receiving portion. The engagement portion includes a resilient member and a trapezoidal portion. The resilient member and the trapezoidal portion are slidably received in the elongated slot of the first and second elongated members such that the member holder is positioned into a plurality of positions within the elongated slots of the first and second elongated members.

20 Claims, 7 Drawing Sheets

(56) References Cited

U.S. PATENT DOCUMENTS

| | | | | |
|---|---|---|---|---|
| 2005/0266936 | A1* | 12/2005 | Gutierrez | A63B 69/0002 473/417 |
| 2007/0202969 | A1* | 8/2007 | Girard | A63B 47/002 473/447 |
| 2011/0294606 | A1* | 12/2011 | Llyod | A63B 69/0071 473/422 |
| 2015/0231470 | A1* | 8/2015 | Kanner | A63B 69/0075 473/417 |
| 2016/0082336 | A1* | 3/2016 | Scionti | A63B 69/34 473/454 |
| 2019/0308083 | A1* | 10/2019 | Childs, II | A63B 69/0071 |
| 2019/0388755 | A1* | 12/2019 | Hall | A63B 69/004 |

OTHER PUBLICATIONS

Webpage download, Techni-Tool, 2005, webarchive.org/web/20050208125657/http://www.techni-toolproducts.com/as03.htm, 1 page.

* cited by examiner

PORTABLE TRAINING DEVICE

TECHNICAL FIELD

The present specification generally relates to sports training devices and, more specifically, to a basketball training device kit.

BACKGROUND

In the sport of basketball, it is known that there are training devices to assist a user in learning how to dribble properly. That is, a skilled basketball player must be able to both dribble low to avoid defensive arms of the opposing team as well as a power dribble to dribble over the arms of a defensive player. These training devices are bulky, not easily movable, are not intended to be easily setup and taken down, and do not offer a plurality of adjustments for every size player and skill level.

Accordingly, a need exists for alternative training devices that are easily transportable, easy to setup and take down, and that offer a plurality of adjustments for every size player and skill level.

SUMMARY

In one embodiment, a portable training device is provided. The portable training device includes a first and second elongated members, a coupling device, a base, a holder device, and a member holder. Each of the first and second elongated members have a distal end and a proximate end. An elongated slot is positioned between the distal end and the proximate end on at least one side of each of the first and second elongated members. The coupling device has a first receiving cavity and a second receiving cavity. The distal end of the first elongated member is received in the first receiving cavity and the proximate end of the second elongated member is received in the second receiving cavity such that the first and second elongated members form a post that extends in a system vertical direction. The base has a base receiving cavity and a flange portion. The flange portion is in contact with a ground surface. The proximate end of the first elongated member is received by the base receiving cavity such that the base supports the first and second elongated members. The holder device has a holder portion and a holder receiving cavity. The distal end of the second elongated member is received within the holder receiving cavity. The holder portion configured to hold an object. The member holder has an engagement portion and an opposite member receiving portion. The engagement portion includes a resilient member and a trapezoidal portion. The resilient member and thee trapezoidal portions are slidably received in the elongated slot of the first and second elongated members such that the member holder is positioned into a plurality of positions within the elongated slots of the first and second elongated members.

In another embodiment, a portable training device is provided. The portable training device includes a first and second elongated members, a coupling device, and a holder device. Each of the first and second elongated members have a distal end and a proximate end. An elongated slot is positioned between the distal end and the proximate end on at least one side of each of the first and second elongated members. The coupling device has a first receiving cavity and a second receiving cavity. The distal end of the first elongated member is received in the first receiving cavity and the proximate end of the second elongated member is received in the second receiving cavity such that the first and second elongated members form a post that extends in a system vertical direction. The holder device has a holder portion and a holder receiving cavity. The distal end of the second elongated member is received within the holder receiving cavity. The holder portion configured to hold an object.

In yet another embodiment, a portable training device is provided. The portable training device includes a first and second elongated members, a coupling device, a base, and a holder device. Each of the first and second elongated members have a distal end and a proximate end. An elongated slot is positioned between the distal end and the proximate end on at least one side of each of the first and second elongated members. The coupling device has a first receiving cavity and a second receiving cavity. The distal end of the first elongated member is received in the first receiving cavity and the proximate end of the second elongated member is received in the second receiving cavity such that the first and second elongated members form a post that extends in a system vertical direction. The base has a base receiving cavity and a flange portion. The flange portion is in contact with a ground surface. The proximate end of the first elongated member is received by the base receiving cavity such that the base supports the first and second elongated members. The holder device has a holder portion and a holder receiving cavity. The distal end of the second elongated member is received within the holder receiving cavity. The holder portion configured to hold an object.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter as defined by the claims. The following detailed description of the illustrative embodiments can be understood when read in conjunction with the following drawings, where like structure is indicated with like reference numerals and in which:

DETAILED DESCRIPTION

Figure 1:
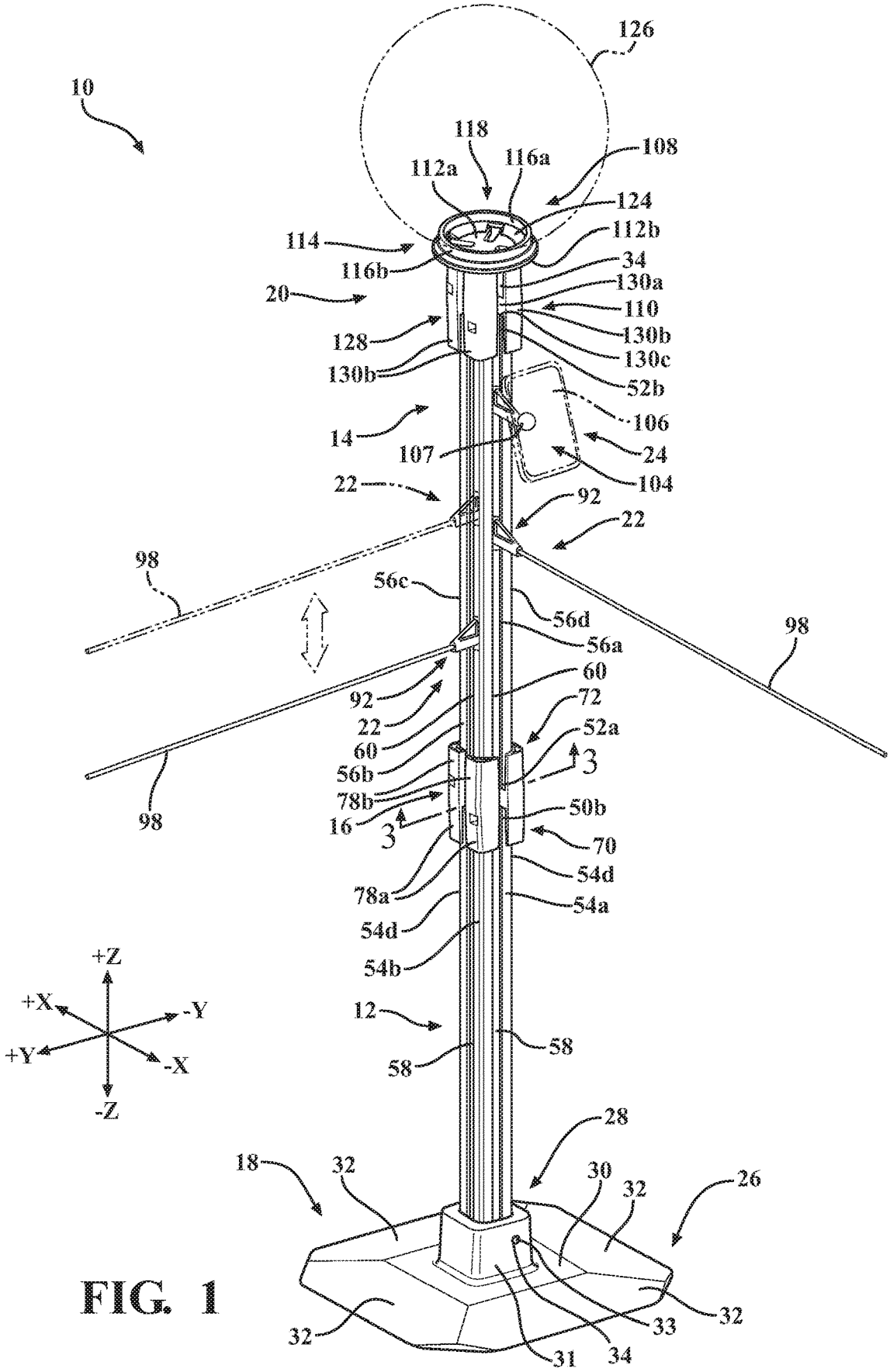
FIG. 1 schematically depicts a perspective view of a training device, according to one or more embodiments shown and described herein.

Embodiments described herein generally relate to a portable training device. The training device includes a pair of elongated members that are coupled to one another by a coupling device. That is, each elongated member includes a distal end and an opposite proximate end. The distal end of one of the pair of elongated members and the proximate end of the other elongated members are received in a respective receiving cavity of the coupling device such that the pair of elongated members and the coupling device form a post that extends in a system vertical direction. Each of the pair of elongated members may include four surfaces such that each of the pair of elongated members may generally be a square shape. Each of the four surfaces includes an elongated slot that extends between the distal end and the proximate end in the system vertical direction.

A member holder is slidably engaged within the elongated slot of at least one of the pair of elongated members such that the member holder may be positioned anywhere along the elongated slot. The member holder includes an engagement portion and a member receiving portion. The engagement portion includes a resilient member and a trapezoidal portion. The resilient member is arcuate and is flexible to move between an unlocked position and a locked positon. The engagement portion may be spring biased to urge the resilient member and the trapezoidal portion into the locked position. As such, the resilient member is in contact with an interior surface of the elongated slot and the trapezoidal portion abuts an inner edge portion of the outer walls of the elongated slot to position or lock the elongated member holder into a plurality of positions along the elongated slots of the elongated members using a force from the engagement portion and an outer surface of the trapezoidal portion against the inner edge surface of the elongated slot.

The member receiving portion receives a member such as a rigid member, an elastic member, and the like. The member extends outwardly from the member receiving portion at different heights based on the locked position of the member holder.

With the member attached to the member holder and the member holder locked into the elongated slot at the desired vertical height, the basketball player can then practice dribbling, ball control, and footwork not only under the outwardly extending member, but also over the outwardly extending member in a power dribble. Furthermore, the training device of the present invention provides instantaneous training feedback for a basketball player such that the basketball player is able to improve his or her skills at a rapid pace.

A mobile device holder is slidably engaged within the elongated slot of at least one of the pair of elongated members such that the mobile device holder may be positioned anywhere along the elongated slot. The mobile device holder includes an engagement portion and a mobile device receiving portion. The engagement portion includes a resilient member and a trapezoidal portion. The resilient member is arcuate and is flexible to move between an unlocked position and a locked positon. The engagement portion may be spring biased to urge the resilient member and the trapezoidal portion into the locked position. As such, the resilient member is in contact with an interior surface of the elongated slot and the trapezoidal portion abuts an inner edge portion of the outer walls of the elongated slot to position or lock the elongated member holder into a plurality of positions along the elongated slots of the elongated members using a force from the engagement portion and an outer surface of the trapezoidal portion against the inner edge surface of the elongated slot.

As used herein, the term "system longitudinal direction" refers to the forward-rearward direction of the system (i.e., in the +/−X direction depicted in FIG. 1). The term "system lateral direction" refers to the cross-direction (i.e., in the +/−Y direction depicted in FIG. 1, and is transverse to the longitudinal direction. The term "system vertical direction" refers to the upward-downward direction of the system (i.e., in the +/−Z-direction depicted in FIG. 1). As used herein, "upper" or "above" is defined as the positive Z direction of the coordinate axis shown in the drawings. "Lower" or "bottom" is defined as the negative Z direction of the coordinate axis shown in the drawings.

Figure 2:
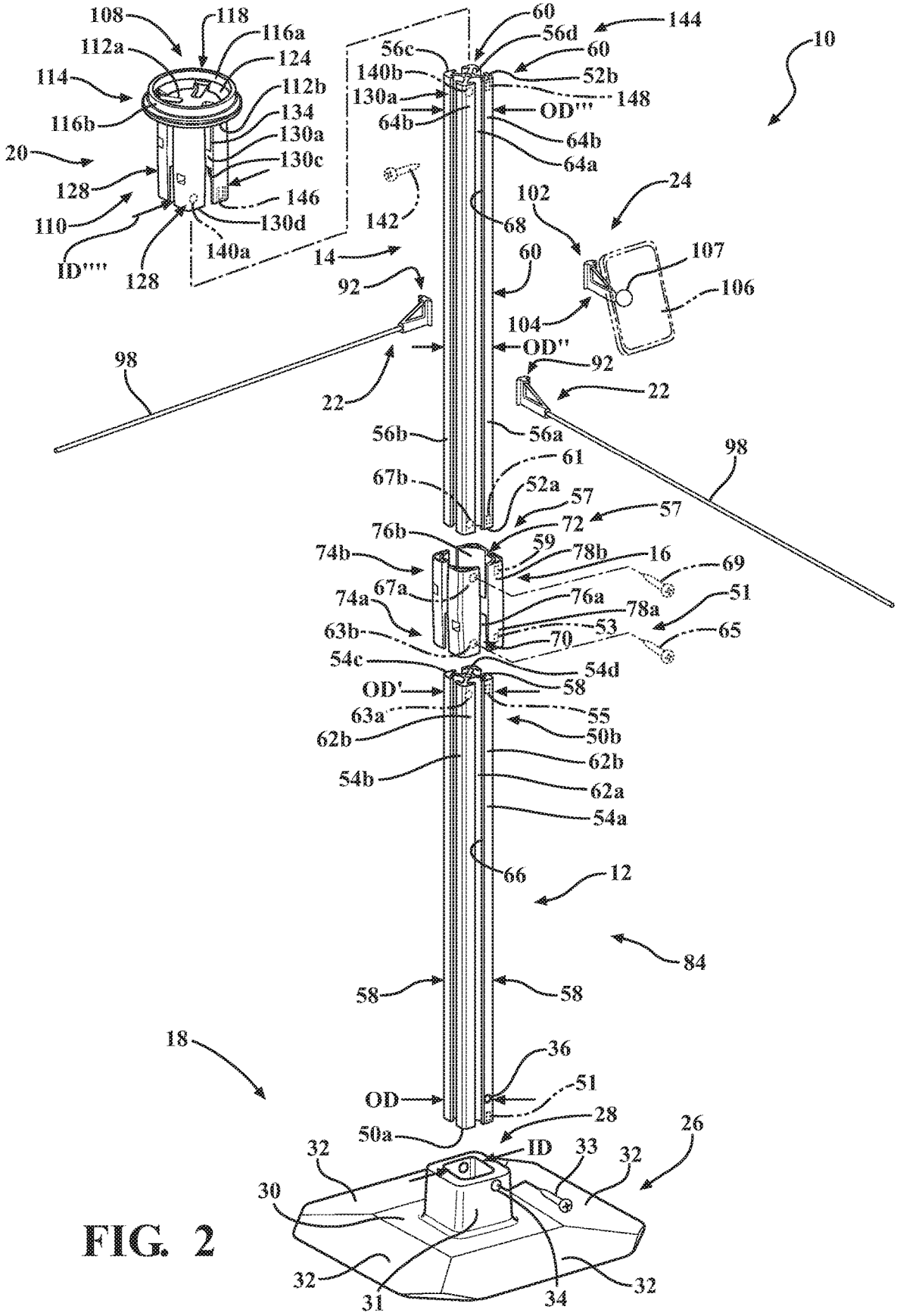
FIG. 2 schematically depicts a perspective exploded view of the training device of FIG. 1, according to one or more embodiments shown and described herein.

With reference first to FIGS. 1 and 2, a portable training device 10 is schematically depicted. The portable training device 10 includes a pair of elongated members 12, 14, a coupling device 16, a base 18, a holder device 20, at least one member holder 22 and a mobile device holder 24.

The base 18 includes a flange portion 26 and a base receiving cavity 28. The flange portion 26 includes a center portion 30 and four walls 32 that each extend in the system longitudinal and lateral directions from the center portion 30 to form a generally square shape. It should be appreciated that base 18 may include more or less flange portions 26, and that the flange portions 26 may be other shapes such as a rectangle, octagon, hexagon, and the like. In some embodiments, each wall 32 is tapered so as to narrow or widen as each wall 32 extends away from the center portion 30. As such, in this embodiment, the flange portion 26 of the base 18 supports the portable training device 10 and the components thereof.

The base receiving cavity 28 extends upwardly from the center portion 30 of the flange portion 26. The base receiving cavity 28 is generally a tube having an inner distance ID that is larger than the outer distance OD of at least a portion of the one of the pair of elongated members 12, 14. In some embodiments, the base receiving cavity 28 is a square shape. In other embodiments, the base receiving cavity 28 may generally be a cylindrical shape, a diamond shape, a hexagonal shape, an octagonal shape, and the like. The base receiving cavity 28 receives a portion of the elongated member 12 or the elongated member 14, as discussed in greater detail herein. In some embodiments, the base receiving cavity 28 includes at least one upwardly extending sidewall 31 that extends upwardly from the center portion 30. The sidewall 31 defines the base receiving cavity 28 and may have a bore 34 extends through the sidewall 31. The bore 34 may be configured to be positioned to align with a bore 36 in the portion of the elongated member 12 that is received in the base receiving cavity 28. A fastener 33, such as a pin, a dowel, a nut and bolt, and the like, may be inserted through the bores 34, 36 to couple the base 18 to the elongated member 12, as shown in FIG. 1. In other embodiments, the portion of one of the pair of elongated members 12 is received in the base receiving cavity 28 in a snap fit configuration.

Referring to FIG. 2, the elongated member 12 includes a proximate end 50*a* and an opposite distal end 50*b*. The elongated member 12 further includes four surfaces 54*a*, 54*b*, 54*c*, 54*d* that extend between the proximate end 50*a* and distal end 50*b*. Each of the four surfaces 54*a*, 54*b*, 54*c*, 54*d* of the elongated member 12 includes an elongated slot 58 that extends between the distal end 50*b* and the proximate end 50*a* in the system vertical direction. The elongated slot 58 may include an interior surface 62*a* and a pair of spaced apart outer walls 62*b* positioned on each side of the interior surface 62*a*. Each of the pair of spaced apart outer walls 62*a* include an inner edge surface 66, that is adjacent to the interior surface 62*a*. In some embodiments, each elongated slot 58 has a trapezoidal cross-sectional shape. In other embodiments, each elongated slot 58 has a cross-sectional shape that is generally a C-shape. In other embodiments, the elongated member 12 may be Unistrut and the like.

In some embodiments, the elongated member 12 may have a generally square outer shape. In other embodiments, the elongated member 12 may generally be a cylindrical shape, a diamond shape, a hexagonal shape, an octagonal shape, and the like.

The elongated member 14 includes a proximate end 52*a* and an opposite distal end 52*b*. The elongated member 14 further includes four surfaces 56*a*, 56*b* 56*c*, 56*d* that extend between the proximate end 52*a* and distal end 52*b*. Each of the four surfaces 56*a*, 56*b* 56*c*, 56*d* of the elongated member 14 includes an elongated slot 60, that extends between the distal end 52*b* and the proximate end 52*a* in the system vertical direction.

Further, the elongated slot 60 may include an interior surface 64*a* and a pair of spaced apart outer walls 64*b* positioned on each side of the interior surface 64*a*. Each of the pair of spaced apart outer walls 64*b* include inner edge surfaces 68 that is adjacent to the interior surface 64*a*, In some embodiments, the elongated slot 60 has a trapezoidal cross-sectional shape. In other embodiments, the elongated slot 60 has a cross-sectional shape that is generally a C-shape. In other embodiments, the elongated member 14 may be Unistrut and the like.

In some embodiments, the elongated member 14 may have a generally square outer shape. In other embodiments, each of the elongated members 12, 14 may generally be a cylindrical shape, a diamond shape, a hexagonal shape, an octagonal shape, and the like.

Now referring to FIGS. 1-3 and 6, the coupling device 16 includes a first receiving cavity 70 and an opposite second receiving cavity 72. The first and second receiving cavities 70, 72 are each formed from two portions 71*a*, 71*b*, each portion having four walls 74*a*, 74*b*. The four walls 74*a* of the first portion 71*a* may be separated or spaced apart forming lower slots 77*a* and may extend in the system vertical direction. The four walls 74*b* of the second portion 71*b* may be separated or spaced apart forming slots 77*b* and may extend in the system vertical direction. It should be appreciated that the four walls 74*a* of the first portion 71*a* define the first receiving cavity 70 and the four walls 74*b* of the second portion 71*b* define the second receiving cavity 72. In some embodiments, a cross member 75, separates the first portion 71*a* from the second portion 71*b*. That is, the first receiving cavity 70 is separated from the second receiving cavity 72 by the cross member 75. That is, the cross member 75 connects or couples each of the walls 74*a* of the first portion 71*a* to one another and connects or couples each of the walls 74*b* of the second portion 71*b* to one another.

In some embodiments, the cross member 75 may be a "X" shape that includes a central portion 75*a* and four struts 75*b*. In other embodiments, the cross member 75 may be planar. It should be appreciated that the cross member 75 may be any shape so long as it is dimensioned and shapes to connect or couple each of the walls 74*a* of the first portion 71*a* to one another and connect or couple each of the walls 74*b* of the second portion 71*b* to one another, which in turn connects or couples the first portion 71*a* to the second portion 76*b*. Further, the cross member 75 may include recesses 79 that correspond to the elongated slots 58, 60 as well as to the lower slots 77*a* and the upper slots 77*b* to allow the at least one member holder, the mobile device holder 24, and the like to extend between elongated members 12, 14 along the elongated slots 58, 60, as discussed in greater detail herein. That is, the recesses 79 of the cross member 75 correspond to the elongated slots 58, 60 of the elongated members 18, 20.

In some embodiments, each wall 74*a* may be generally an L shape with an arm 97*a* and a leg 99*a*. The leg 99*a* includes an inner surface 76*a* an opposite outer surface 78*a*. The arm 97*a* includes an end surface 80*a* an abutment surface 85*a*, and an opposite opening 82*a*. Each of the four walls 74*a* define the first receiving cavity 70 with an inner distance ID''' extending between the inner surface 76*a* of the leg 99*a* of two walls 74*a*, (while shown in FIG. 6 with respect to the second portion 71*b*, the ID''' is identical to that of the first portion 71*a*). The inner distance ID' is larger than the outer distance OD' of the portion of the elongated member 12 that is received in the first receiving cavity 70, as discussed in greater detail herein.

In some embodiments, the first receiving cavity 70 receives a portion of the elongated member 12 in a friction fit configuration. In other embodiments, the first receiving cavity 70 receives a portion of the elongated member 12 in a snap fit configuration by a snap tab assembly 51 which includes a resilient member 53 having a tab portion positioned on the inner surface 76*a* of the leg 99*a* and a notch 55 that corresponds to the tab portion of the resilient member 53 is positioned on the portion of the elongated member 12 received in the first receiving cavity 70. In other embodiments, at least one wall 74*a* of the first portion 71*a* and the portion of the elongated member 12 received in the first receiving cavity 70 both include a bore 63*a*, 63*b* configured for a fastener 65, such as a pin, bolt, screw, and the like, to secure the portion of the elongated member 12 into the first receiving cavity 70. In some embodiments, the distal end 50*b* of the elongated member 12 is received in the first receiving cavity 70 of the coupling device 16 such that the elongated member 12 and the coupling device 16 extend in a system vertical direction.

In some embodiments, each wall 74*b* may be generally an L shape with an arm 97*b* and a leg 99*b*. The leg 99*b* includes an inner surface 76*b* an opposite outer surface 78*b*. The arm 97*b* includes an end surface 80*b*, an abutment surface 85*b*, and an opposite opening 82*b*. Each of the four walls 74*b* define the second receiving cavity 72 with an inner distance ID''' extending between the inner surface 76*b* of the leg 99*b* of two different walls 74*b*. The inner distance ID''' is larger than the outer distance OD'' of the portion of the elongated member 14 that is received in the second receiving cavity 72, as discussed in greater detail herein. Further, in some embodiments, the four struts 75*b* connect to the legs 99*a*, 99*b* of the walls 74*a*, 74*b*.

In some embodiments, the second receiving cavity 72 receives a portion of the elongated member 14 in a friction fit configuration. In other embodiments, the second receiving cavity 72 receives a portion of the elongated member 14 in a snap fit configuration by a snap tab assembly 57, which includes a resilient member 59 having a tab portion positioned on the inner surface 76*b* of the leg 99*b* and a notch 61 that corresponds to the tab portion of the resilient member 59 positioned on the portion of the elongated member 14 received in the second receiving cavity 72. In other embodiments, at least one wall 74*b* of the second portion 71*b* and the portion of the elongated member 14 received in the second receiving cavity 72 both include a bore 67*a*, 67*b* configured for a fastener 69, such as a pin, bolt, screw, and the like, to secure the portion of the elongated member 12 into the first receiving cavity 70. In some embodiments, the proximate end 52*a* of the elongated member 14 is received in the second receiving cavity 72 of the coupling device 16 such that the elongated member 14 and the coupling device 16 extend in a system vertical direction.

It should be appreciated that the abutment surface 85*a* abuts the abutment surface 85*b*. Further, the cross member 75 extends between the arms 97*a*, 97*b* to couple the walls 74*a* to the walls 74*b* and provide support. It should be appreciated that, in some embodiments, the base receiving cavity 28 is a square shape. In other embodiments, the first receiving cavity 70 and/or the second receiving cavity 72 may be a square shape. In other embodiments, the first receiving cavity 70 and/or the second receiving cavity 72 may generally be a cylindrical shape, a diamond shape, a hexagonal shape, an octagonal shape, and the like.

When the distal end 50*b* of the elongated member 12 and the proximate end 52*a* of the elongated member 14 are received in the respective first and second receiving cavities 70, 72 of the coupling device 16, the pair of elongated members 12, 14 and the coupling device 16 form a post 84 that extends in a system vertical direction. That is, one of the pair of elongated members 12 becomes a lower portion of the post 84 and the other one of the pair of elongated members 14 becomes the upper portion of the post 84. Further, it should be appreciated that the elongated slots 58, 60 of each respective pair of elongated members 12, 14 are aligned with one another along the length of the post 84.

The elongated member 12 that forms the lower portion of the post 84 is positioned within the base receiving cavity 28. That is, the proximate end 50*a* of the elongated member 12 is received into the base receiving cavity 28 such that the elongated member 12 extends upwardly in the system vertical direction with respect to the center portion 30.

Figure 3:
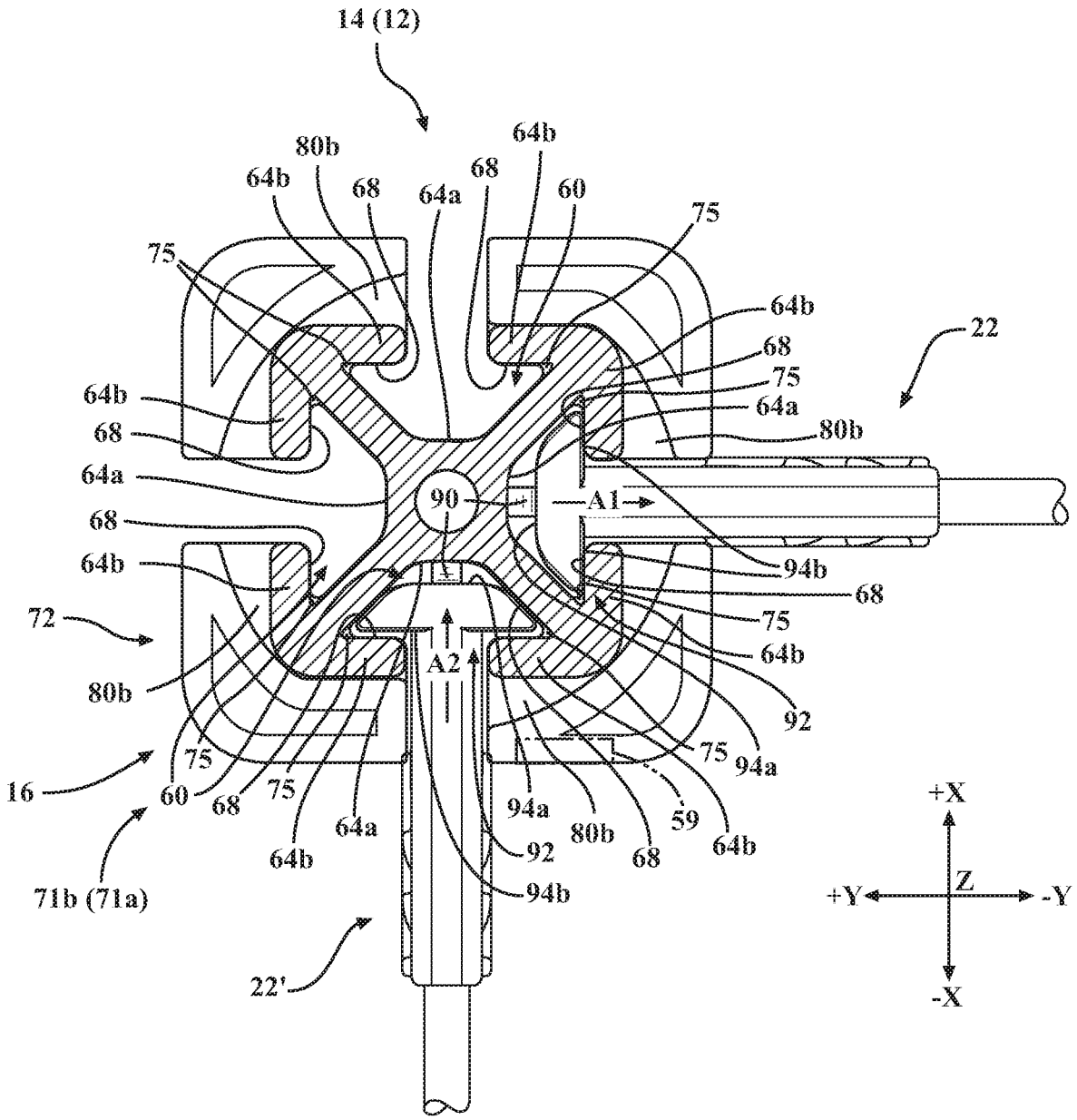
FIG. 3 schematically depicts a partial cross-sectional view of the training device of FIG. 1 taken along the line 3-3 in which an elongated member holder is engaged within an elongated slot of an elongated member, according to one or more embodiments shown and described herein.
Figure 4:
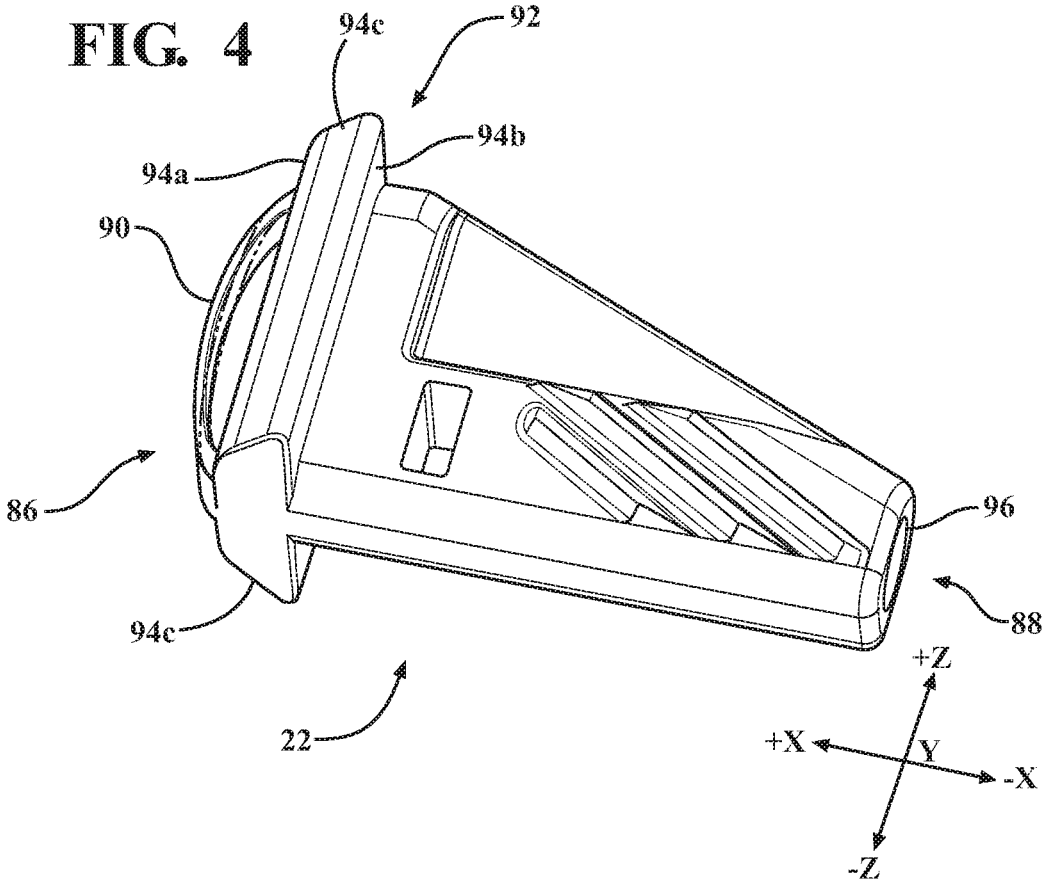
FIG. 4 schematically depicts an isolated perspective view of the elongated member holder of FIG. 1, according to one or more embodiments shown and described herein.

Now referring to FIGS. 1-4, the member holder 22 is slidably engaged within the elongated slot 58, 60 of at least one of the pair of elongated members 12, 14 such that the member holder 22 may be positioned anywhere along the elongated slots 58, 60. The member holder 22 includes an engagement portion 86 and an opposite member receiving portion 88. The engagement portion 86 includes a biasing member or resilient member 90, such as a spring, and a shaped portion 92 that corresponds to the shape of the elongated slots 58, 60 of the elongated members 12, 14. The shaped portion 92 includes an inner surface 94*a* and an opposite outer surface 94*b* connected by a pair of parallel surfaces 94*c*. The parallel surfaces 94*c* may be angled with respect to the inner surface 94*a* and the outer surface 94*b*. In some embodiments, the shaped portion 92 may be a trapezoidal shape. In other embodiments, the shaped portion 92 may be square, rectangular, circular, hexagonal, octagonal, and the like. In embodiments, the resilient member 90 is arcuate and is flexible to move between an unlocked position, as shown in FIG. 3 with the member holder 22' and a locked positon, as shown in FIG. 3 with the member holder 22. The resilient member 90 is biased outwardly such that in the locked position, the resilient member 90 engages with the interior surface 64*a* of the elongated slot 60 and to friction fit the shaped portion 92 against the inner edge surfaces 68 of the spaced apart outer walls 64*b* of the elongated slot 60, as discussed in greater detail herein.

It should be appreciated that the top down cross section view of FIG. 3 is of the elongated member 14 and the second receiving cavity 72 of the coupling device 16. As such, only the interaction between the member holder 22 and the elongated slot 60 will be discussed herein. It should be appreciated that the interactions apply to the elongated slot 58 of the elongated member 12. The resilient member 90 is in contact with the interior surface 64*a* of the elongated slot 60 and the shaped portion 92 abuts the inner edge surfaces 68 of the spaced apart outer walls 64*b* of the elongated slot 60 to position or lock the member holder 22 into a plurality of positions along the elongated slots 60 of the elongated member 14. It should be appreciated that the resilient member 90 is biased outwardly against the interior surface 64*a* of the elongated slot 60 to generate a friction force such that the outer surface 94*b* of the shaped portion 92 is biased against the inner edge surface 68 of the spaced apart outer walls 64*b* of the elongated slot 60. In the unlocked position, the resilient member 90 is compressed inwardly towards the interior surface 64*a*, as illustrated by the arrow A2, which creates a gap between the outer surface 94*b* of the shaped portion 92 and the inner edge surface 68 of the elongated slot 60. As such, the shaped portion 92 is released from the inner edge surface 68 of each of the pair of spaced apart outer walls 64*b* of the elongated slot 60, as shown with the member holder 22'.

It should be appreciated that the member holder 22 and in particular, the resilient member 90 and the shaped portion 92 may travel anywhere along the post 84 within both elongated slots 58, 60 of the elongated members 12, 14 without disengaging from the elongated slots 58, 60.

In some embodiments, the member receiving portion 88 includes an aperture 96 that receives a member 98 such as a rigid member. In other embodiments, the member 98 is an elastic member, a resilient member, and the like. The member 98 extends outwardly from the member receiving portion 88 at different heights based on the position of the member holder 22 along the post 84.

With the member 98 received in the aperture 96 of the member holder 22 and the member holder 22 locked into the elongated slot 60 at the desired vertical height, the athlete can then practice using the member 98. For example, the athlete may practice dribbling, ball control, and footwork not only under the outwardly extending member 98, but also over the outwardly extending member 98 in a power dribble. In another example, the athlete may practice karate or fencing using the member holder 22 as a target, as a guide to improve distance or height of strikes, and the like. It should be appreciated that the portable training device 10 provides instantaneous training feedback for the athlete such that the athlete is able to improve his or her skills at a rapid pace.

Figure 5:
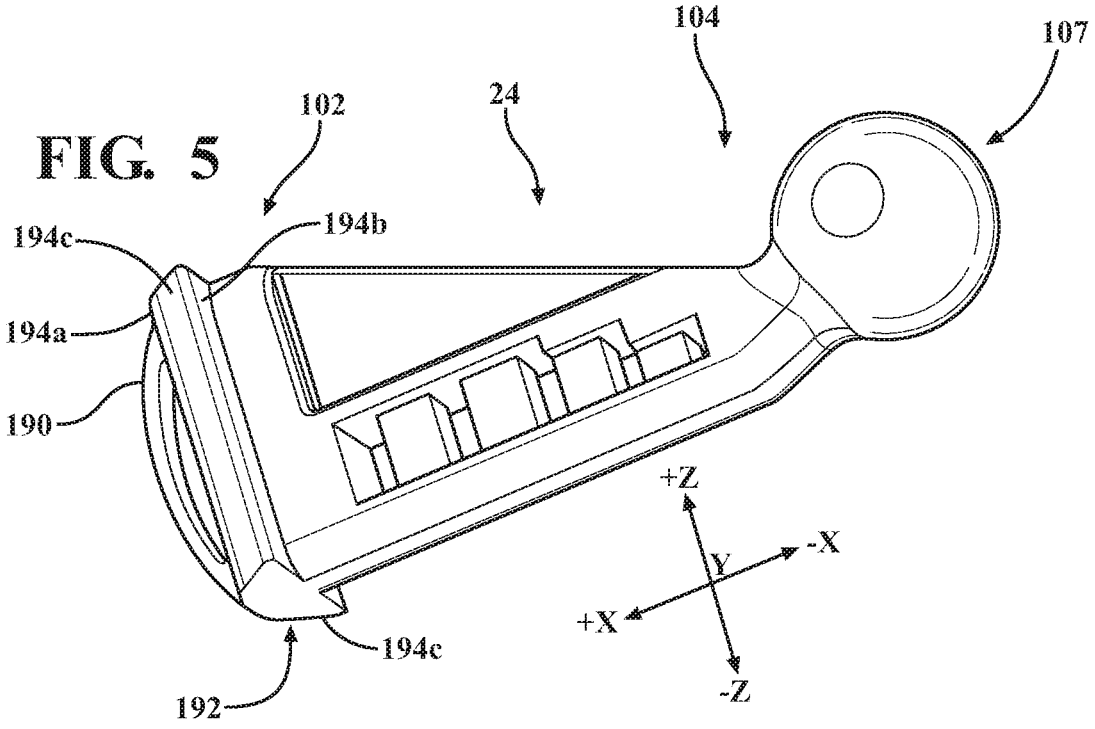
FIG. 5 schematically depicts an isolated perspective view of a mobile electronic device holder of the training device of FIG. 1, according to one or more embodiments shown and described herein.
Figure 6:
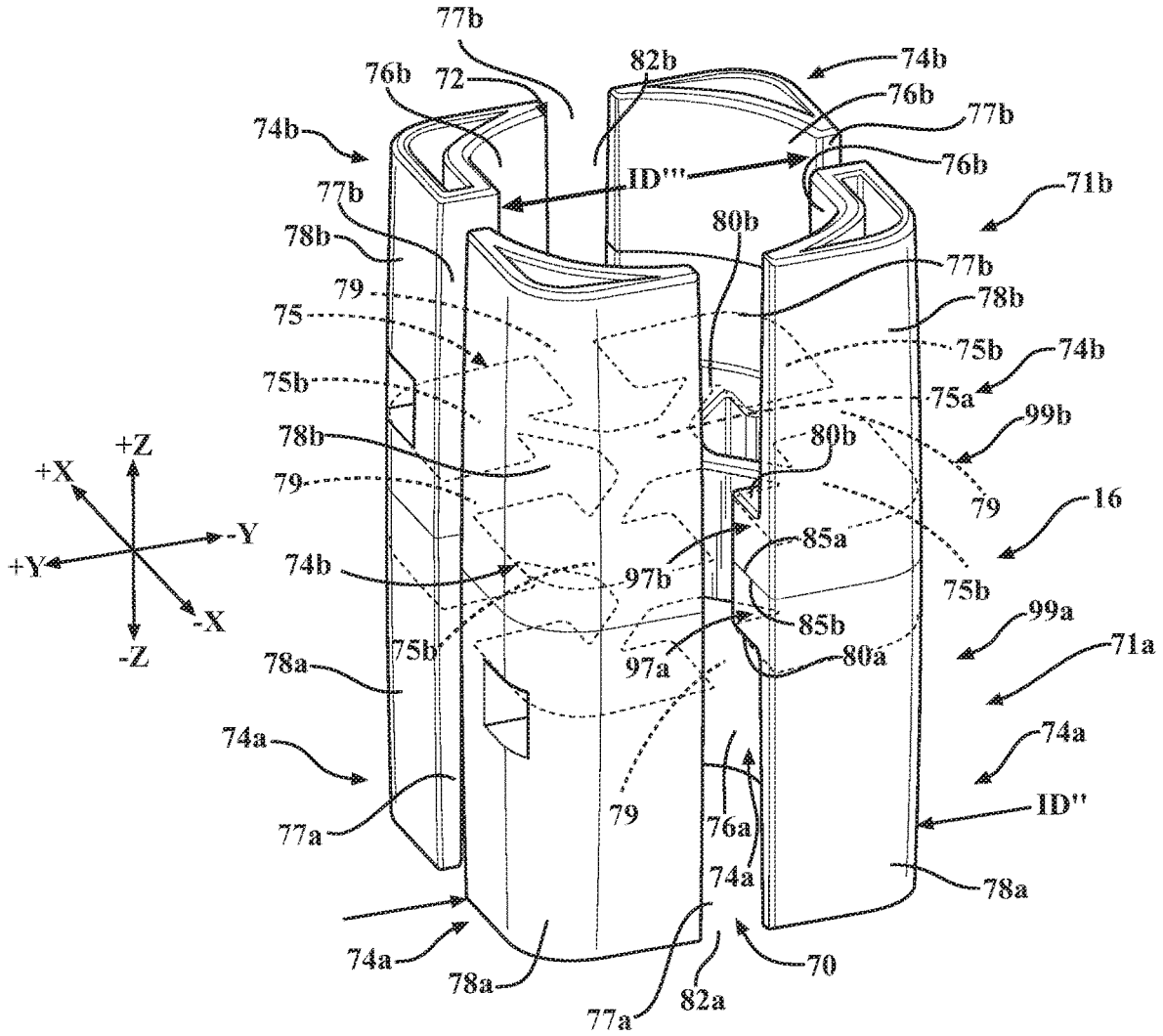
FIG. 6 schematically depicts an isolated perspective view of a coupling device of the training device of FIG. 1, according to one or more embodiments shown and described herein.

Now referring to FIGS. 1-2 and 5, the mobile device holder 24 is slidably engaged within the elongated slots 58, 60 of the post 84. That is, the mobile device holder 24 may slide along the elongated slots 58, 60 and through the coupling device 16 such that the mobile device holder 24 may be positioned anywhere along the elongated slot 58, 60. The mobile device holder 24 includes an engagement portion 102 and a mobile device receiving portion 104.

The engagement portion 102 includes a resilient member 190, such as a spring, and a shaped portion 192 that corresponds to the shape of the elongated slots 58, 60 of the elongated members 12, 14. The shaped portion 192 includes an inner surface 194*a* and an opposite outer surface 194*b* connected by a pair of parallel surfaces 194*c*. The parallel surfaces 194*c* may be angled with respect to the inner surface 194*a* and the outer surface 194*b*. In some embodiments, the shaped portion 192 may be a trapezoidal shape. In other embodiments, the shaped portion 192 may be square, rectangular, circular, hexagonal, octagonal, and the like. In embodiments, the resilient member 190 is arcuate and is flexible to move between an unlocked position and a locked positon similar to the member holder 22 and member holder 22', as discussed above. The resilient member 190 is biased outwardly such that in the locked position, the resilient member 190 engages with the interior surface 64*a* of the elongated slot 60 and to friction fit the shaped portion 192 against the inner edge surfaces 68 of the spaced apart outer walls 64*b* of the elongated slot 60, as discussed in greater detail herein.

It should be appreciated that the resilient member 190 is biased outwardly against the interior surface 64*a* of the elongated slot 60 to generate a friction force such that the outer surface 194*b* of the shaped portion 192 is biased against the inner edge surface 68 of the spaced apart outer walls 64*b* of the elongated slot 60. In the unlocked position, the resilient member 190 is compressed inwardly towards the interior surface 64*a*, which creates a gap between the outer surface 194*b* of the shaped portion 192 and the inner edge surface 68 of the elongated slot 60. As such, the shaped portion 192 is released from the inner edge surface 68 of each of the pair of spaced apart outer walls 64*b* of the elongated slot 60. It should be appreciated that the mobile device holder 24 and in particular, the resilient member 190 and the shaped portion 192 may travel anywhere along the post 84 within both elongated slots 58, 60 of the elongated members 12, 14 without disengaging from the elongated slots 58, 60.

Figure 7:
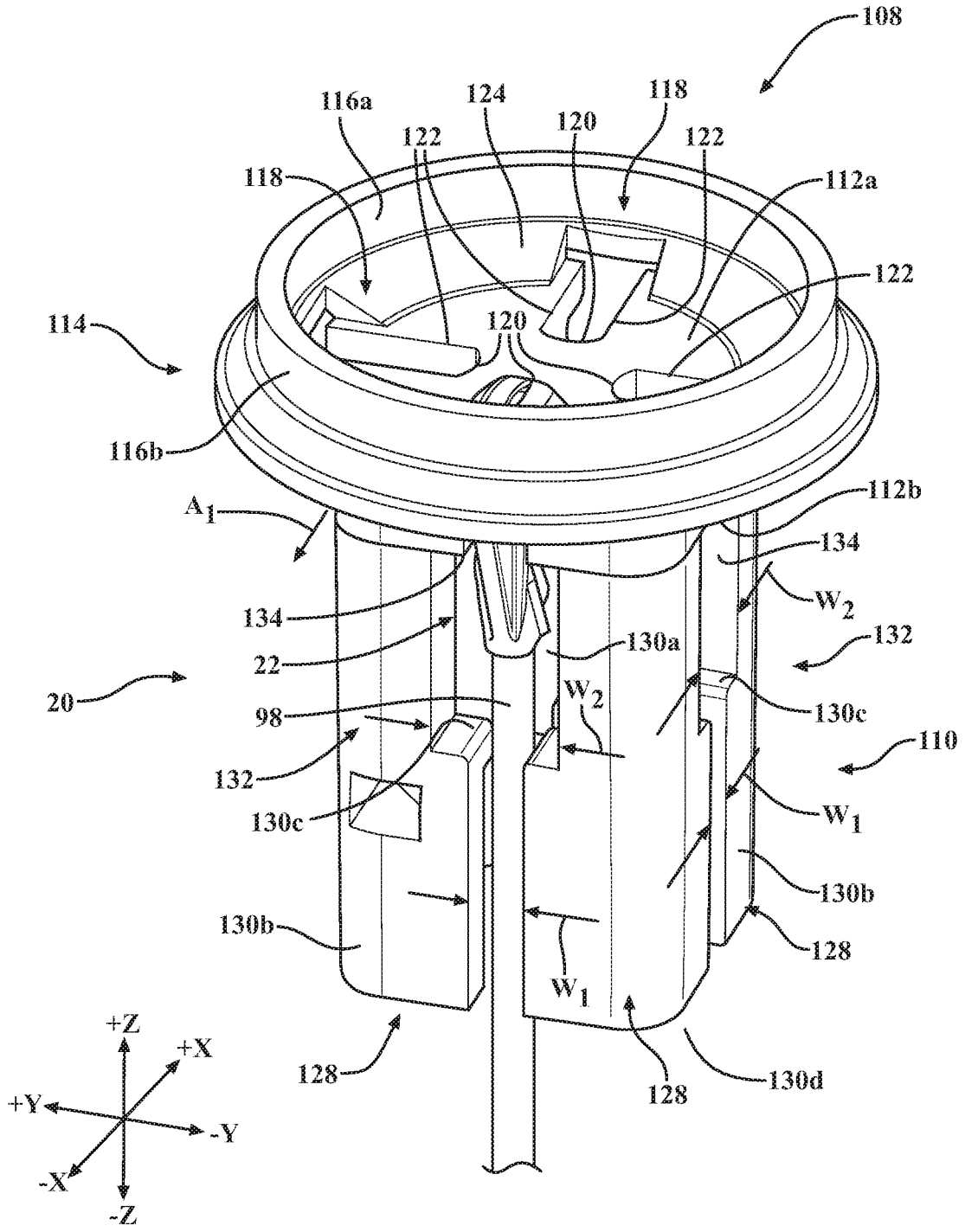
FIG. 7 schematically depicts an isolated perspective view of a holding member of the training device of FIG. 1, according to one or more embodiments shown and described herein.

The mobile device holder 24 may include a mobile device receiving portion 104, such as a ball joint 107, which is configured to receive a portion of the portable electronic device 106. The portable electronic device 106 may be a tablet, a smart phones, a laptop and the like. In some embodiments, the ball joint 107 allows for the portable electronic device 106 to pivot or swivel. Now referring to FIGS. 1-2 and 7, the holder device 20 includes a holder portion 108 and a holder receiving cavity 110. The holder portion 108 includes an interior surface 112*a* and a lower surface 112*b*. The interior surface 112*a* is surrounded by a continuous wall 114 that extends above the interior surface 112*a* in the system vertical direction and includes an inner surface 116*a* and opposite exterior surface 116*b*. In some embodiments, the continuous wall 114 is circular. In other embodiments, the continuous wall 114 is square, rectangular, octagonal, hexagonal, and the like. The holder portion 108 further includes a plurality of slots 118 extending through the interior surface 112*a* and the lower surface 112*b* at predetermined intervals. Each of the slots 118 includes a rounded portion 120 connecting two legs 122 that extends from the rounded portion 120 towards the continuous wall 114.

A partial lip 124 extends from the inner surface 116*a* of the continuous wall 114 and abuts the interior surface 112*a*. The partial lip 124 is positioned around an interior circumference of the continuous wall 114. As such, the partial lip 124 extends from the inner surface 116*a* and between each of the slots 118. In some embodiments, the partial lip 124 is tapered as the partial lip 124 extends away from the inner surface 116*a* of the continuous wall 144. As such, the thickness of the partial lip 124 changes as the partial lip 124 extends from the continuous wall 114. It should be appreciated that the structure of the holder portion 108 (i.e., the continuous wall 114, the partial lip 124, and the interior surface 112*a* form a general bowl shape to hold or position an object 126 within, such as a basketball.

The holder receiving cavity 110 extends from the lower surface 112*b* of the holder portion 108. That is, the holder receiving cavity 110 is positioned below the holder portion 108 in the system vertical direction. Each wall 128 may include an inner surface 130*a* and an opposite outer surface 130*b*. Further, each wall 128 may include a terminating surface 130*c* and an opposite opening 134*d*. The terminating surface 130*c* be planar and may extend generally perpendicular to at least a portion of the outer surface 130*b*. The holder receiving cavity 110 is generally defined by the inner surface 130*a* of the four spaced apart walls 128 that extend in the system vertical direction, the opening 134*d* and the terminating surface 130*c*. The inner surface 130*a* of two opposite walls 128 define an inner distance ID' of the holder receiving cavity 110, which is larger than the outer distance OD''' of the portion of the elongated member 14 that is received in the holder receiving cavity 110, as discussed in greater detail herein.

The distal end 52*b* of the elongated member 14 that forms the upper portion of the post 84 is received in the holder receiving cavity 110. As such, the holder receiving cavity 110 may be a shaped to fit the distal end 52*b* of the elongated member 14, such as a square shape. In some embodiments, the holder receiving cavity 110 may generally be a cylindrical shape, a diamond shape, a hexagonal shape, an octagonal shape, and the like.

In some embodiments, the holder receiving cavity 110 receives a portion of the elongated member 14 in a friction fit configuration. In other embodiments, the holder receiving cavity 110 receives a portion of the elongated member 14 in a snap fit configuration a snap tab assembly 145, which includes a resilient member 146 having a tab portion positioned on the inner surface 130*a* of at least one wall 128 and a notch 148 that corresponds to the tab portion of the resilient member 146 positioned on the distal end 52*b* of the elongated member 14 received in the holder receiving cavity 110. In other embodiments, at least one wall 128 of the holder receiving cavity 110 and the distal end 52*b* of the elongated member 14 received in the holder receiving cavity 110 both include a bore 140*a*, 140*b* configured for a fastener 142, such as a pin, bolt, screw, and the like, to secure the distal end 52*b* into the holder receiving cavity 110.

Figure 8:
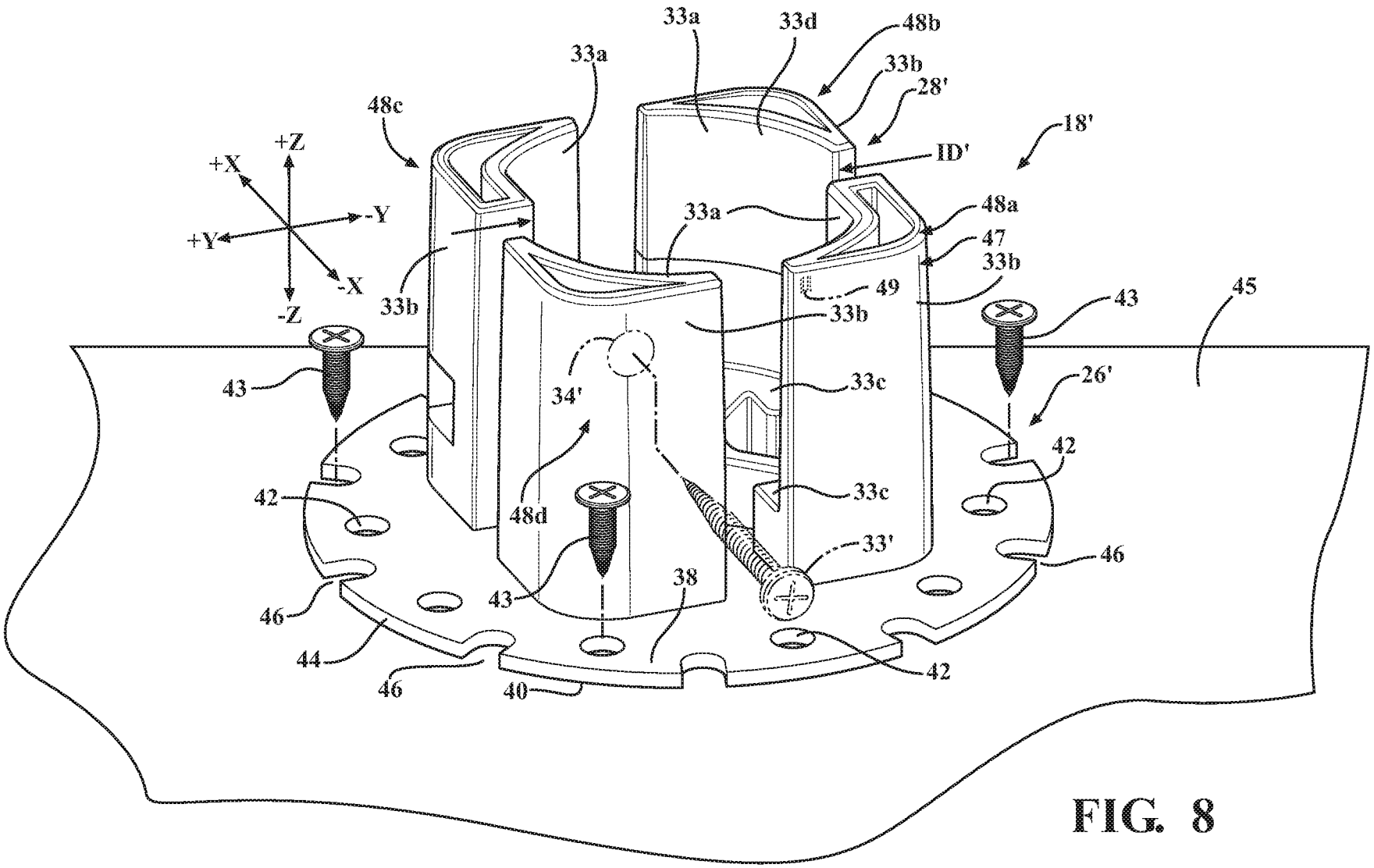
FIG. 8 schematically depicts an isolated perspective view of another embodiment of a base portion of the training device of FIG. 1, according to one or more embodiments shown and described herein.

Now referring to FIGS. 1-2, 4-5 and 7, the outer surface 130*b* of each of the spaced apart walls 128 further include recesses 132 extending between the opening 130*d* of the holder receiving cavity 110 and the lower surface 112*b* of the holder portion 108. The recesses 132 have a width W1 near the opening 130*d* of the holder receiving cavity 110 that is narrower than a width W2 positioned near the lower surface 112*b* of the holder portion 108. The width W1 is wide enough to accommodate a width of the member 98 and the width W2 provides enough area to receive the member holder 22 and/or the mobile device holder 24. The width W2 includes an inside edge portion 134 that is configured to receive the outer surface 94*b* of the shaped portion 92, as discussed in greater detail herein. As such, it should be appreciated that the member holder 22 and/or the mobile device holder 24 may be positioned into the recesses 132 such that the engagement portion 86 engages with the corresponding recess 132 and slot 118 of the holder portion 108 to position or lock the member holder 22 and/or the mobile device holder 24 into a storage position, as best shown in FIG. 8. That is, in the storage position, the resilient member 90 is received within the one of the plurality of slots 118 and the outer surface 94*b* of the shaped portion 92 abuts the inside edge portion 134 of the recess 132.

In the storage position, the member 98 of the member holder 22 extends in the system vertical direction parallel to the elongated member 14, which forms the upper portion of the post 84. In some embodiments, the member 98 of the member holder 22 is positioned within the recesses 132 such that the member 98 is positioned within the corresponding elongated slot 60 of the elongated member 14 in the storage positon. It should be appreciated that the member holder 22 may be releasably coupled to the slot 118 of the holder portion 108 via the engagement portion 86 and thus is released into a use position by biasing the resilient member 90 and the outer surface 94*b* of the shaped portion 92 is released from the inside edge portion 134 of the recess 132 so to no longer be in contact with the slot 118 or recess 132 such that the member holder 22 may be removed in the direction of the arrow A1.

Now referring to FIGS. 2 and 8, in a second embodiment, all the components of the portable training device 10 are identical with the exception of a base 18', which will now be described. The base 18' includes a flange portion 26' that is generally a circular plate with an upper surface 38 and an opposite bottom surface 40. A plurality of apertures 42 are positioned in the flange portion 26' and extend between the upper and bottom surfaces 38, 40. The plurality of apertures 42 may be configured to receive a fastener 43, such as a bolt and nut, a screw, a rivet, and the like, to secure the flange portion 26' to a floor surface 45. An outer peripheral circumferential edge 44 of the flange portion 26' includes a plurality of notches 46 that extend radially inwardly and are spaced apart along the edge 44 of the flange portion 26'. The plurality of notches 46 may be configured to receive the fastener 43 to secure the flange portion 26' to the floor surface 45.

A plurality, for example, four of spaced apart walls 48*a*, 48*b*, 48*c*, 48*d* each extend upwardly from the upper surface 38 of the flange portion 26' to define the base receiving cavity 28'. Each wall 48*a*, 48*b*, 48*c*, 48*d* may include an inner surface 33*a* and an opposite outer surface 33*b*. Further, each wall 48*a*, 48*b*, 48*c*, 48*d* may include a terminating surface 33*c* and an opposite opening 33*d*. The terminating surface 33*c* be planar and may extend generally perpendicular to at least a portion of the outer surface 33*b*. The base receiving cavity 28' is generally defined by the inner surface 33*a* of the four spaced apart walls 48*a*, 48*b*, 48*c*, 48*d* that extend in the system vertical direction, the opening 33*d* and the terminating surface 33*c*. The inner surface 33*a* of two opposite walls 48*a*, 48*b*, 48*c*, 48*d* define the inner distance ID' of the base receiving cavity 28', which is larger than the outer distance OD of the portion of the elongated member 12 that is received in the base receiving cavity 28'.

In this embodiment, the portion of the elongated member 12 is received in the base receiving cavity 28' in a friction fit configuration. In other embodiments, the base receiving cavity 28' receives a portion of the elongated member 12 in a snap fit configuration by a snap tab assembly 47, which includes a resilient member 49 having a tab portion positioned on the inner surface 33*a* of at least one wall 48*a*, 48*b*, 48*c*, 48*d* and a notch 51 that corresponds to the tab portion of the resilient member 49 positioned on the proximate end 50*a* of the elongated member 12 received in the base receiving cavity 28'. In other embodiments, at least one wall 48*a*, 48*b*, 48*c*, 48*d* of the base receiving cavity 28' includes a bore 34' that extends through the at least one wall 48*a*, 48*b*, 48*c*, 48*d*. The bore 34' may be configured to be positioned to align with the bore 36 in the portion of the elongated member 12 that is received in the base receiving cavity 28'. A fastener 33', such as a pin, a dowel, a nut and bolt, and the like, may be inserted through the bores 34', 36 to couple the base 18' to the elongated member 12.

Now referring back to FIGS. 1-2 and 3, to assemble the portable training device 10, the base 18 is positioned in the desired location. The elongated member 12 that forms the lower portion of the post 84 is coupled to the base 18 via the base receiving cavity 28. The second receiving cavity 72 of the coupling device 16 is then positioned onto the distal end 50*b* of the elongated member 12 that forms the lower portion of the post 84 and the first receiving cavity 70 of the coupling device 16 receives the proximate end 52*a* of the elongated member 14 that forms the upper portion of the post 84.

The user then positions the member holder 22 and/or the mobile device holder 24 into the elongated slot 60 and releasably slides the member holder 22 and/or the mobile device holder 24 to the desired height. That is, the user inserts the member holder 22 and/or the mobile device holder 24 into the elongated slot 60 via an opening at the distal end 52*b*. The member 98 is then positioned onto the distal end of the elongated member that forms the upper portion of the post. The member holder 22 and the member 98 may be moved, of course, by either longitudinally or laterally displacing the member holder 22 depending on the location of the member holder 22 (i.e., which side and/or which elongated slot 58, 60 the member holder 22 is positioned within in reference to the direction depicted in FIG. 1 to release the force of the engagement portion 86 and then sliding the member holder 22 in the system vertical direction to the desired height. Further, the mobile device holder 24 may be positioned in the same manner.

From the foregoing, it can be seen that the embodiments described herein provide for a portable training device that is able to be kitted and positioned into storage and the like when not in use. Further, the portable training device is easily transportable, easy to setup and take down, and offers a plurality of adjustments for every size player and skill level.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A portable training device comprising:

a first and second elongated member, each of the first and second elongated members having a distal end and a proximate end, an elongated slot is positioned between the distal end and the proximate end on at least one side of each of the first and second elongated members;

a coupling device having a first receiving cavity and a second receiving cavity, the distal end of the first elongated member is received in the first receiving cavity and the proximate end of the second elongated member is received in the second receiving cavity such that the first and second elongated members form a post that extends in a system vertical direction, a base having a base receiving cavity and a flange portion, the flange portion is in contact with a ground surface, the proximate end of the first elongated member is received by the base receiving cavity such that the base supports the first and second elongated members;

a holder device having a holder portion and a holder receiving cavity, the distal end of the second elongated member is received within the holder receiving cavity, the holder portion configured to hold an object; and a member holder having an engagement portion and an opposite member receiving portion, the engagement portion includes a resilient member and a shaped portion, the resilient member and the shaped portion are slidably received in the elongated slot of the first and second elongated members such that the member holder is positioned into a plurality of positions within the elongated slots of the first and second elongated members.

2. The portable training device of claim 1, wherein the member holder is movable between a locked position and an unlocked position.

3. The portable training device of claim 2, wherein:

each elongated slot of the first and second elongated member includes an interior surface and a pair of spaced apart outer walls having an inner edge portion, the shaped portion includes an inner surface and an outer surface, the resilient member extends from the inner surface towards the interior surface of each elongated slot.

4. The portable training device of claim 3, wherein in the locked position, the resilient member is biased against the interior surface of the elongated slot such that the outer surface of the shaped portion abuts the inner edge portion of each of the pair of spaced apart outer walls.

5. The portable training device of claim 3, wherein in the unlocked position, the resilient member is biased against the interior surface of the elongated slot such that the outer surface of the shaped portion is released from the inner edge portion of each of the pair of spaced apart outer walls.

6. The portable training device of claim 5, wherein:

the holder portion includes an interior surface and a lower surface, the interior surface is surrounded by a continuous wall that extends above the interior surface in the system vertical direction.

7. The portable training device of claim 6, wherein the holder portion further includes a plurality of slots extending through the interior surface and the lower surface at predetermined intervals.

8. The portable training device of claim 7, wherein the holder receiving cavity extends from the lower surface of the holder portion, the holder receiver cavity is defined by four spaced apart walls that extend in the system vertical direction, each of the four spaced apart walls include a recess that includes an inside edge portion configured to receive the member holder.

9. The portable training device of claim 8, wherein the member holder is movable between a storage position and a use position.

10. The portable training device of claim 9, wherein in the storage position, the resilient member is received within the one of the plurality of slots and the outer surface of the shaped portion abuts the inside edge portion of the recess.

11. The portable training device of claim 10, wherein in the use position, the resilient member is released from the one of the plurality of slots and the outer surface of the shaped portion is released from the inside edge portion of the recess.

12. The portable training device of claim 1, further comprising:

a mobile device holder having a mobile device engagement portion and a mobile device receiving portion, the mobile device engagement portion includes a resilient member and a shaped portion, the resilient member and the shaped portion of the mobile device engagement portion are slidably received in the elongated slot of the first and second elongated members such that the mobile device holder is positioned into a plurality of positions within the elongated slots of the first and second elongated members.

13. The portable training device of claim 12, wherein the mobile device holder is movable between a locked position and an unlocked position.

14. The portable training device of claim 13, wherein:

each elongated slot of the first and second elongated member includes an interior surface and a pair of spaced apart outer walls having an inner edge portion, the shaped portion of the mobile device engagement portion includes an inner surface and an outer surface, the resilient member extends from the inner surface towards the interior surface of each elongated slot.

15. The portable training device of claim 14, wherein in the locked position, the resilient member of the mobile device engagement portion is biased against the interior surface of the elongated slot such that the outer surface of the shaped portion of the mobile device engagement portion abuts the inner edge portion of each of the pair of spaced apart outer walls.

16. The portable training device of claim 15, wherein in the unlocked position, the resilient member of the mobile device engagement portion is biased against the interior surface of the elongated slot such that the outer surface of the shaped portion of the mobile device engagement portion is released from the inner edge portion of each of the pair of spaced apart outer walls.

17. The portable training device of claim 15, wherein the shaped portion of the mobile device engagement portion is a trapezoidal shape.

18. The portable training device of claim 1, wherein the shaped portion is a trapezoidal shape.

19. A portable training device comprising:

a first and second elongated member, each of the first and second elongated members having a distal end and a proximate end, an elongated slot is positioned between the distal end and the proximate end on at least one side of each of the first and second elongated members;

a coupling device having a first receiving cavity and a second receiving cavity, the distal end of the first elongated member is received in the first receiving cavity and the proximate end of the second elongated member is received in the second receiving cavity such that the first and second elongated members form a post that extends in a system vertical direction, and a holder device having a holder portion and a holder receiving cavity, the distal end of the second elongated member is received within the holder receiving cavity, the holder portion configured to hold an object.

20. A portable training device comprising:

a first and second elongated member, each of the first and second elongated members having a distal end and a proximate end, an elongated slot is positioned between the distal end and the proximate end on at least one side of each of the first and second elongated members;

a coupling device having a first receiving cavity and a second receiving cavity, the distal end of the first elongated member is received in the first receiving cavity and the proximate end of the second elongated member is received in the second receiving cavity such that the first and second elongated members form a post that extends in a system vertical direction, a base having a base receiving cavity and a flange portion, the flange portion is in contact with a ground surface, the proximate end of the first elongated member is received by the base receiving cavity such that the base supports the first and second elongated members; and a holder device having a holder portion and a holder receiving cavity, the distal end of the second elongated member is received within the holder receiving cavity, the holder portion configured to hold an object.

* * * * *